US005357984A

United States Patent [19]

Farrier et al.

[11] Patent Number: 5,357,984

[45] Date of Patent: Oct. 25, 1994

[54] METHOD OF FORMING AN ELECTROCHEMICAL HEAT SOURCE

[75] Inventors: Ernest G. Farrier, Winston-Salem; Joseph J. Chiou, Clemmons, both of N.C.; Richard L. Lehman, Franklin, N.J.

[73] Assignee: R. J. Reynolds Tobacco Company, Winston-Salem, N.C.

[21] Appl. No.: 862,158

[22] Filed: Apr. 2, 1992

Related U.S. Application Data

[63] Continuation of Ser. No. 722,778, Jun. 28, 1991, Pat. No. 5,285,798.

[51] Int. Cl.[5] ..... A24B 15/00; A24B 15/18

[52] U.S. Cl. ..... 131/369; 131/194; 131/359

[58] Field of Search ..... 131/270–273, 131/194, 195, 359, 369; 44/500, 545, 551, 553, 555, 596

[56] References Cited

U.S. PATENT DOCUMENTS

| | | | |
|---|---|---|---|
| 3,207,149 | 9/1965 | Spindler | 126/263 |
| 3,258,015 | 6/1966 | Ellis et al. | 131/171 |
| 3,623,471 | 11/1971 | Bogue et al. | 126/263 |
| 3,683,936 | 8/1972 | O'Neil, Jr. | 131/8 |
| 3,766,079 | 10/1973 | Jackman et al. | 252/188.3 R |
| 3,774,589 | 11/1973 | Kober | 126/263 |
| 3,851,654 | 12/1974 | Kober | 132/33 |
| 3,871,357 | 3/1975 | Grosso et al. | 126/263 |
| 3,878,118 | 4/1975 | Watson | 252/90 |
| 3,884,216 | 5/1975 | McCartney | 126/204 |
| 3,903,011 | 9/1975 | Donnelly | 252/188.3 R |
| 3,906,926 | 9/1975 | Staples | 126/263 |
| 3,920,476 | 11/1975 | Black et al. | 136/100 R |
| 3,942,511 | 3/1976 | Black et al. | 126/248 |
| 3,976,049 | 8/1976 | Yamashita et al. | 126/263 |
| 3,993,577 | 11/1976 | Black et al. | 252/188 |
| 4,013,061 | 3/1977 | Trumble et al. | 126/263 |
| 4,017,414 | 4/1977 | Black et al. | 252/188 |
| 4,057,047 | 11/1977 | Gossett | 126/263 |
| 4,067,313 | 1/1978 | Donnelly | 126/263 |
| 4,080,953 | 3/1978 | Mitchell et al. | 126/263 |
| 4,091,174 | 5/1978 | Ruch et al. | 429/27 |
| 4,094,298 | 6/1978 | Kober | 126/263 |
| 4,095,583 | 6/1978 | Petersen et al. | 126/263 |
| 4,098,258 | 7/1978 | Kober | 126/263 |
| 4,119,082 | 10/1978 | Miyamori et al. | 126/263 |
| 4,142,508 | 3/1979 | Watson | 126/263 |

(List continued on next page.)

FOREIGN PATENT DOCUMENTS

| | | |
|---|---|---|
| 276250 | 7/1965 | Australia . |
| 441441 | 3/1927 | Fed. Rep. of Germany . |
| 626744 | 3/1936 | Fed. Rep. of Germany . |
| 775380 | 5/1957 | United Kingdom . |
| 1033674 | 6/1966 | United Kingdom . |

OTHER PUBLICATIONS

12th IECEC, No. 779150, entitled Supercorroding Alloys for Generating Heat and Hydrogen Gas by S. S. Sergev and S. A. Black.

*Primary Examiner*—V. Millin
*Assistant Examiner*—J. Doyle
*Attorney, Agent, or Firm*—Grover M. Myers

[57] ABSTRACT

A method of making an electrochemical heat source is disclosed. The non-combustion heat source includes at least two metallic agents capable of interacting electrochemically with one another, such as magnesium and iron or nickel. The metallic agents may be provided in a variety of forms, including a frozen melt, a bimetallic foil, wire of a first metal wrapped around strands of a different metal, and a mechanical alloy. The metallic agents may be in the form of a powder filling a straw, or small particles extruded with a binder or pressed to form a rod. The powder filled straw or rod may be placed in a heat chamber surrounded by tobacco in a smoking article. An electrolyte solution contacts the metallic agents in the heat chamber to initiate the electrochemical interaction, generating heat which in turn may be used to volatilize nicotine and flavor materials in the tobacco.

30 Claims, 7 Drawing Sheets

U.S. PATENT DOCUMENTS

| | | | |
|---|---|---|---|
| 4,149,548 | 4/1979 | Bradshaw | 131/170 A |
| 4,158,084 | 6/1979 | Prentice | 429/112 |
| 4,169,190 | 9/1979 | Ruch et al. | 429/27 |
| 4,186,746 | 2/1980 | Byler | 128/403 |
| 4,189,528 | 2/1980 | Klootwyk | 429/70 |
| 4,205,957 | 6/1980 | Fujiwara | 44/3 R |
| 4,209,413 | 6/1980 | Kent et al. | 252/70 |
| 4,223,661 | 9/1980 | Sergev et al. | 126/204 |
| 4,255,157 | 3/1981 | Yamaguchi et al. | 44/3 C |
| 4,264,362 | 4/1981 | Sergev et al. | 75/243 |
| 4,265,216 | 5/1981 | Marshall et al. | 126/263 |
| 4,268,272 | 5/1981 | Taura | 44/3 R |
| 4,282,005 | 8/1981 | Sato et al. | 44/3 R |
| 4,322,483 | 3/1982 | Tune | 429/50 |
| 4,338,098 | 7/1982 | Yamaji | 44/3 A |
| 4,366,804 | 1/1983 | Abe | 126/263 |
| 4,393,884 | 7/1983 | Jacobs | 131/273 |
| 4,425,251 | 1/1984 | Gancy | 252/70 |
| 4,430,988 | 2/1984 | Krasberg | 126/206 |
| 4,522,190 | 6/1985 | Kuhn et al. | 126/263 |
| 4,613,444 | 9/1986 | Lane et al. | 252/70 |
| 4,774,971 | 10/1988 | Vieten | 131/273 |
| 4,913,168 | 4/1990 | Potter et al. | 131/194 |
| 4,917,119 | 4/1990 | Potter et al. | 131/273 |
| 4,938,236 | 7/1990 | Banerjee et al. | 131/194 |
| 4,941,483 | 7/1990 | Ridings et al. | 131/194 |
| 4,955,399 | 9/1990 | Potter et al. | 131/359 |

FIG. 4
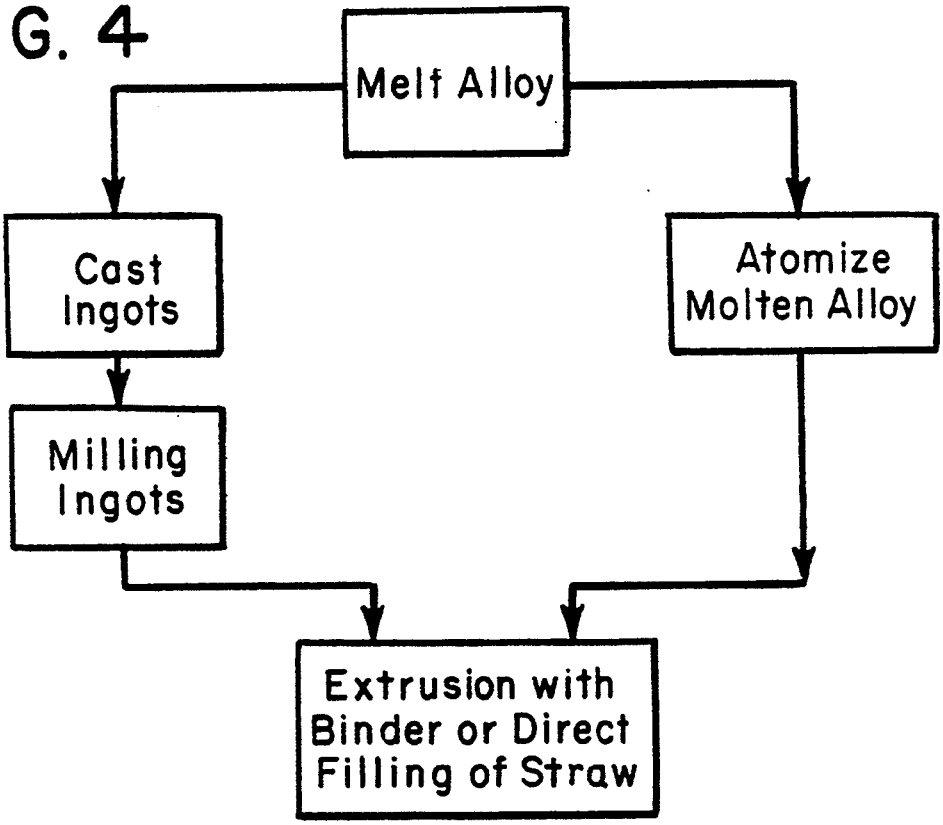
FIG. 5
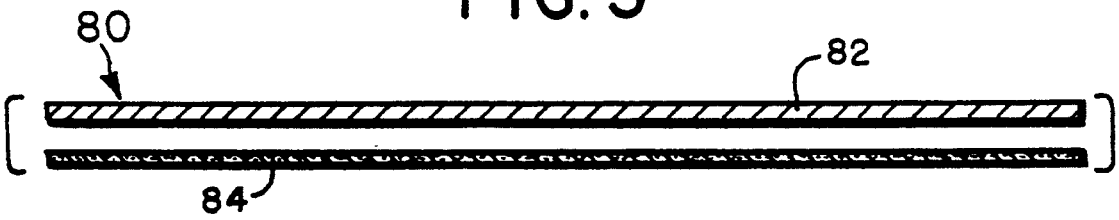
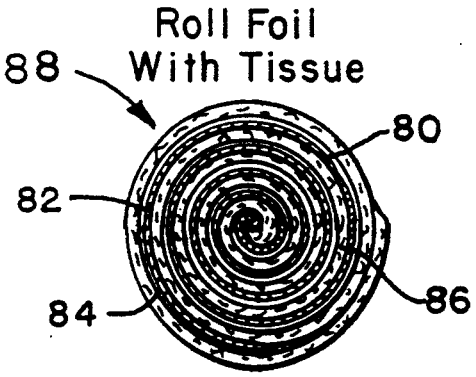
FIG.5a
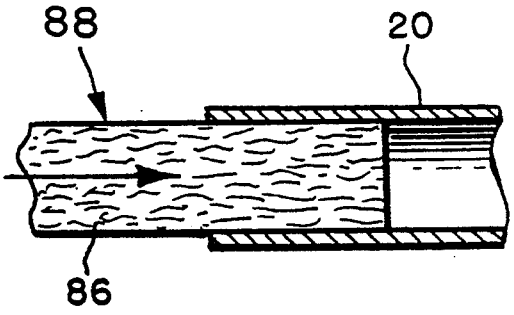
FIG.5b

FIG. 11
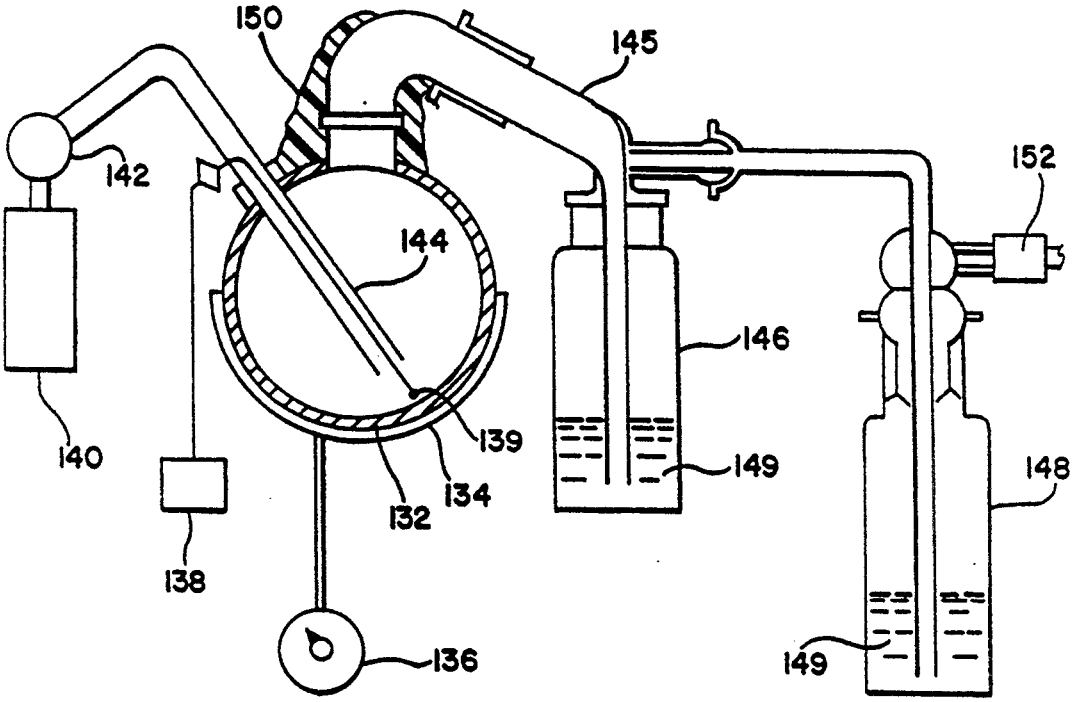
FIG. 10
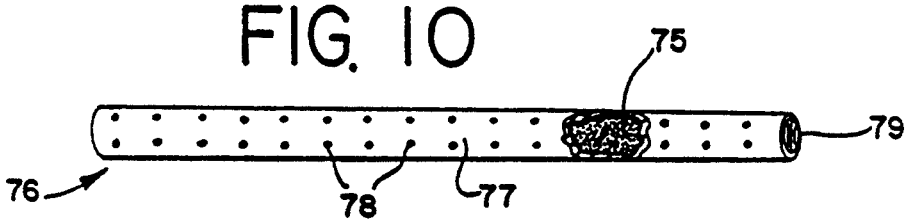
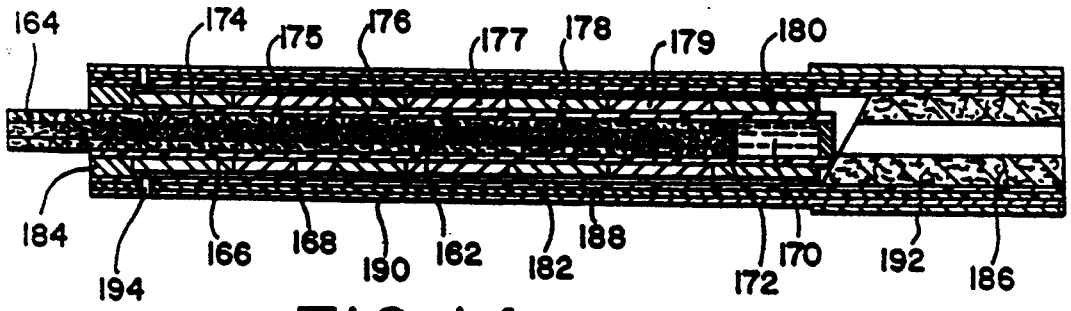
FIG. 14

METHOD OF FORMING AN ELECTROCHEMICAL HEAT SOURCE

CROSS REFERENCE TO RELATED APPLICATION

This application is a continuing application based on application Ser. No. 07/722,778, filed Jun. 28, 1991, entitled "Tobacco Smoking Article with Electrochemical Heat Source," now U.S. Pat. No. 5,285,798, the disclosure of which is hereby incorporated by reference.

BACKGROUND OF THE INVENTION

The present invention relates to methods of forming electrochemical heat sources, and in particular to electrochemical heat sources to heat tobacco to produce a tobacco flavor or tobacco-flavored aerosol.

The electrochemical heat sources of the present invention are particularly adapted for use in smoking articles that are capable of providing the user with the pleasures of smoking (e.g., smoking taste, feel, satisfaction, and the like), without burning tobacco or any other material, without producing sidestream smoke or odor, and without producing combustion products such as carbon monoxide. As used herein, the term "smoking article" includes cigarettes, cigars, pipes, and the like, which use tobacco in various forms.

Many smoking articles have been proposed through the years as improvements upon, or alternatives to, smoking products which burn tobacco.

Many tobacco substitute smoking materials have been proposed, and a substantial listing of such materials can be found in U.S. Pat. No. 4,079,742 to Rainer et al. Tobacco substitute smoking materials having the tradenames Cytrel and NSM were introduced in Europe during the 1970's as partial tobacco replacements, but did not realize any long-term commercial success Numerous references have proposed smoking articles which generate flavored vapor and/or visible aerosol. Most of such articles have employed a combustible fuel source to provide an aerosol and/or to heat an aerosol forming substance. See, for example, the background art cited in U.S. Pat. No. 4,714,082 to Banerjee et al.

However, despite decades of interest and effort, no one had successfully developed a smoking article which provided the sensations associated with cigarette or pipe smoking, without delivering considerable quantities of incomplete combustion and pyrolysis products.

Recently, however, in U.S. Pat. Nos. 4,708,151 to Shelar, 4,714,082 to Banerjee et al., 4,756,318 to Clearman et al. and 4,793,365 to Sensabaugh et al., there are described smoking articles which are capable of providing the sensations associated with cigarette and pipe smoking, without burning tobacco or delivering considerable quantities of incomplete combustion products. Such articles rely on the combustion of a fuel element for heat generation, resulting in the production of some combustion products.

Over the years, there have been proposed numerous smoking products which utilize various forms of energy to vaporize or heat tobacco, or attempt to provide the sensations of cigarette or pipe smoking without burning any substance. For example, U.S. Pat. No. 2,104,266 to McCormick proposed an article having a pipe bowl or cigarette holder which included an electrical resistance coil. Prior to use of the article, the pipe bowl was filled with tobacco or the holder was fitted with a cigarette.

Current was then passed through the resistance coil. Heat produced by the resistance coil was transmitted to the tobacco in the bowl or holder, resulting in the volatilization of various ingredients from the tobacco.

U.S. Pat. No. 3,258,015 and Australian Patent No. 276,250 to Ellis et al. proposed, among other embodiments, a smoking article having cut or shredded tobacco mixed with a pyrophorous material such as finely divided aluminum hydride, boron hydride, calcium oxide or fully activated molecular sieves. In use, the pyrophorous material generates heat which reportedly heated the tobacco to a temperature between 200° C. and 400° C. to cause the tobacco to release volatilizable materials. Ellis et al. also proposed a smoking article including cut or shredded tobacco separated from a sealed pyrophorous material such as finely divided metallic particles. In use, the metallic particles were exposed to air to generate heat which reportedly heated the tobacco to a temperature between 200° C. and 400° C. to release aerosol forming materials from the tobacco.

PCT Publication No. WO 86/02528 to Nilsson et al. proposed an article similar to that described by McCormick. Nilsson et al. proposed an article for releasing volatiles from a tobacco material which had been treated with an aqueous solution of sodium carbonate. The article resembled a cigarette holder and reportedly included a battery operated heating coil to heat an untipped cigarette inserted therein. Air drawn through the device reportedly was subjected to elevated temperatures below the combustion temperature of tobacco and reportedly liberated tobacco flavors from the treated tobacco contained therein. Nilsson et al. also proposed an alternate source of heat whereby two liquids were mixed to produce heat.

Despite many years of interest and effort, none of the foregoing non-combustion articles has ever realized any significant commercial success, and it is believed that none has ever been widely marketed. Moreover, it is believed that none of the foregoing non-combustion articles is capable of adequately providing the user with many of the pleasures of cigarette or pipe smoking.

Thus, it would be desirable to produce a heat source that can be used to construct a smoking article which can provide many of the pleasures of cigarette or pipe smoking, which does not burn tobacco or other material, and which does not produce any combustion products.

SUMMARY OF THE INVENTION

The present invention relates to methods of producing electrochemical heat sources, particularly for use in heating tobacco to provide a tobacco flavor and other pleasures of smoking to the user thereof. Preferred tobacco smoking articles using heat sources of the present invention produce controlled amounts of volatilized tobacco flavors and other substances which do not volatilize to any significant degree under ambient conditions, and such volatilized substances can be provided throughout each puff, for at least 6 to 10 puffs, the normal number of puffs for a typical cigarette.

More particularly, the present invention relates to a heat source which generates heat in a controlled manner as a result of one or more electrochemical interactions between the components thereof. In a smoking article employing such a heat source, the tobacco, which can be in a processed form, is positioned physically separate from, and in a heat exchange relationship with, the heat source. By "physically separate" it is meant that the tobacco used for providing flavor is not mixed with, or is not a part of, the heat source.

The heat source includes at least two metallic agents which are capable of interacting electrochemically with one another. The metallic agents can be provided within the smoking article in a variety of ways. For example, the metallic agents and an undissociated electrolyte can be mixed within the smoking article, and interactions therebetween can be initiated upon the introduction of a solvent for the electrolyte. Alternatively, the metallic agents can be provided within the smoking article, and interactions therebetween can be initiated upon the introduction of an electrolyte solution.

A preferred heat source is a mixture of solid components which provide the desired heat delivery upon interaction of certain components thereof with a liquid solvent, such as water. For example, a solid mixture of granular magnesium and iron particles, granular potassium chloride crystals, and finely divided cellulose can be contacted with liquid water to generate heat. Heat is generated by the exothermic hydroxylation of magnesium; and the rate of hydroxylation of the magnesium is accelerated in a controlled manner by the electrochemical interaction between magnesium and iron, which interaction is initiated when the potassium chloride electrolyte dissociates upon contact with the liquid water. The cellulose is employed as a dispersing agent to space the components of the heat source, as well as to act as a reservoir for the electrolyte and solvent, and hence control the rate of the exothermic hydroxylation reaction. Preferred heat sources also include, or are used with electrolytes which include, an oxidizing agent in an amount sufficient to oxidize reaction products of the hydroxylation reaction, and hence generate a further amount of heat and water. An example of a suitable oxidizing agent is sodium nitrate.

Preferred heat sources generate relatively large amounts of heat to rapidly heat at least a portion of the tobacco to a temperature sufficient to volatilize flavorful components from the tobacco. For example, preferred smoking articles employ a heat source capable of heating at least a portion of the tobacco to above about 70° C. within about 30 seconds from the time that the heat source is activated. Preferred smoking articles employ heat sources which avoid excessive heating of the tobacco and maintain the tobacco within a desired temperature range for about 4 to about 8 minutes or longer. For the preferred smoking articles, the heat source thereof heats the tobacco contained therein to a temperature range between about 70° C. and about 180° C., more preferably between about 85° C. and about 120° C., during the useful life of the smoking article.

The tobacco can be processed or otherwise treated so that the flavorful components thereof readily volatilize at those temperatures experienced during use. In addition, the tobacco can contain or carry a wide range of added flavors and aerosol forming substances which volatilize at those temperatures experienced during use. For example, depending upon the temperature generated by the heat source, the smoking article can yield, in addition to the flavorful volatile components of the tobacco, a flavor such as menthol, and/or a visible aerosol provided by an aerosol forming substance (e.g., propylene glycol, glycerin).

To use the smoking article constructed with a heat source of the invention, the smoker initiates the interactions between the components of the heat source, and heat is generated. The interaction of the components of the heat source provides sufficient heat to heat the tobacco, and tobacco flavors and other flavoring substances are volatilized from the tobacco. When the smoker draws on the smoking article, the volatilized substances pass through the smoking article and into the mouth of the smoker. As such, the smoker is provided with many of the flavors and other pleasures associated with cigarette smoking without burning any materials.

The methods of forming the heat sources of the present invention are described in greater detail in the accompanying drawings and in the detailed description of the invention which follows.

BRIEF DESCRIPTION OF THE DRAWINGS

FIG. 4 is a block diagram outlining several alternative methods of producing electrochemical agents for use in the cigarette of FIGS. 1 and 2;

FIGS. 5, 5*a* and 5*b* are schematic representations of another embodiment of a heat source for the cigarette of FIG. 2;

FIG. 10 is a schematic representation of another embodiment of a heat source for the cigarette of FIG. 2;

FIG. 11 is a schematic representation of a system for extracting and collecting tobacco flavors;

FIG. 14 is a longitudinal, sectional view of the cigarette of FIG. 13 showing the heat source partially inserted into the heat chamber.

DETAILED DESCRIPTION OF PREFERRED EMBODIMENTS

Unless specified otherwise, all percentages used herein are percentages by weight.

Figure 1:
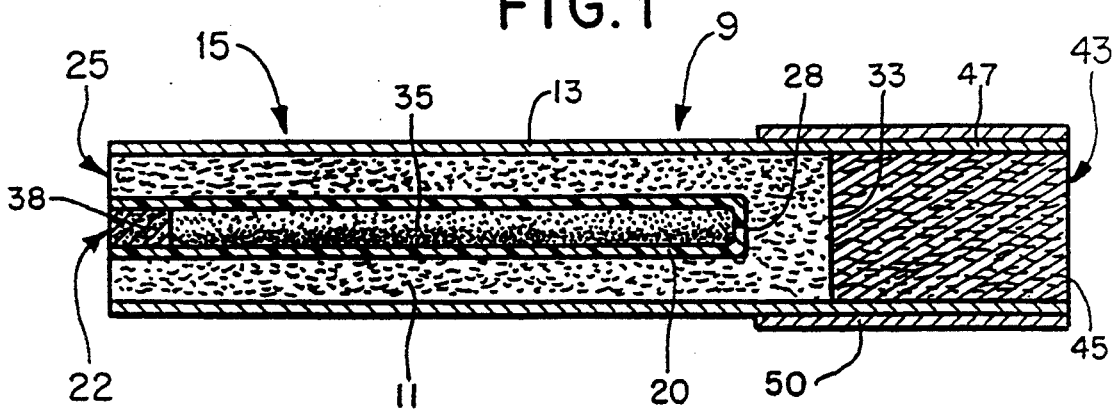
FIG. 1 is a longitudinal, sectional view of a cigarette containing a heat source of a first preferred embodiment of the present invention.

Referring to FIG. 1, cigarette 9 has an elongated, essentially cylindrical rod shape. The cigarette includes a roll or charge of tobacco 11 wrapped in a generally tubular outer wrap 13 such as cigarette paper, thereby forming a tobacco rod 15. An example of a suitable outer wrap is calcium carbonate and flax fiber cigarette paper available as Reference No. 719 from Kimberly- Clark Corp. The roll of tobacco 11 may be a blend of tobaccos in cut filler form as shown, or may be in the form of rolled tobacco sheet. In addition, the preferred tobacco is cased and top dressed with flavoring agents. Within the roll of tobacco filler is positioned a heat chamber 20 having an open end 22 near the air inlet region 25 of the cigarette, and a sealed end 28 toward the mouth end 33 of the tobacco rod 15. The heat chamber 20 can be manufactured from a heat conductive material (e.g., aluminum), a plastic material (e.g., mylar), or any material which is heat resistant up to the temperature generated by the heat source. The heat chamber is preferably a good heat conductor, with a low heat capacity. Preferably the heat chamber is light weight, water impervious, and strong enough so that it does not rupture, even when wet. Even some coated papers may be used to construct the heat chamber 20. When the heat chamber 20 is manufactured from an electrically conductive material (e.g., aluminum), it is preferred that the inner portion of the heat chamber 20 be composed of an electrically insulative material if no other electrical insulation is used in the system.

Within the heat chamber 20 is positioned a heat source 35 (discussed in detail hereinafter). In the embodiment shown, the heat source 35 is maintained in place within the heat chamber 20 by a plug 38, such as moisture impermeable, plasticized cellulose acetate tow having a thin surface coating of a low melting point paraffin wax, or a resilient open cell foam material covered with a thin coating of paraffin wax. As such, there is provided a moisture barrier for storage, as well as a material having an air permeable character when the heat source 35 generates heat. The resulting tobacco rod 15 has the heat source 35 embedded therein, but such that the tobacco and heat source 35 are physically separate from one another. The tobacco rod 15 has a length which can vary, but generally has a length of about 5 mm to about 90 mm, preferably about 40 mm to about 80 mm, and more preferably about 55 mm to about 75 mm; and a circumference of about 22 mm to about 30 mm, preferably about 24 mm to about 27 mm.

Filter element 43 is axially aligned with, and positioned in an end-to-end relationship with the tobacco rod 15. Since there are no combustion products, the filter element 43 performs primarily as a mouth piece. The filter element 43 may be a cellulose acetate tube or may include a filter material 45, such as a gathered or pleated polypropylene web, or the like, and an outer wrapper 47, such as a paper plug wrap. Highly preferred filter elements 43 exhibit no, or relatively low, filtration efficiencies. Normally, the circumference of the filter element 43 is similar to that of the tobacco rod 15, and the length ranges from about 10 mm to about 35 mm. A representative filter element 43 can be provided as described in U.S. Pat. No. 4,807,809 to Pryor et al. The filter element 43 and tobacco rod 15 are held together using tipping paper 50. Normally, tipping paper 50 has adhesive applied to the inner face thereof, and circumscribes the filter element 43 and an adjacent region of the tobacco rod 15.

Figure 2:
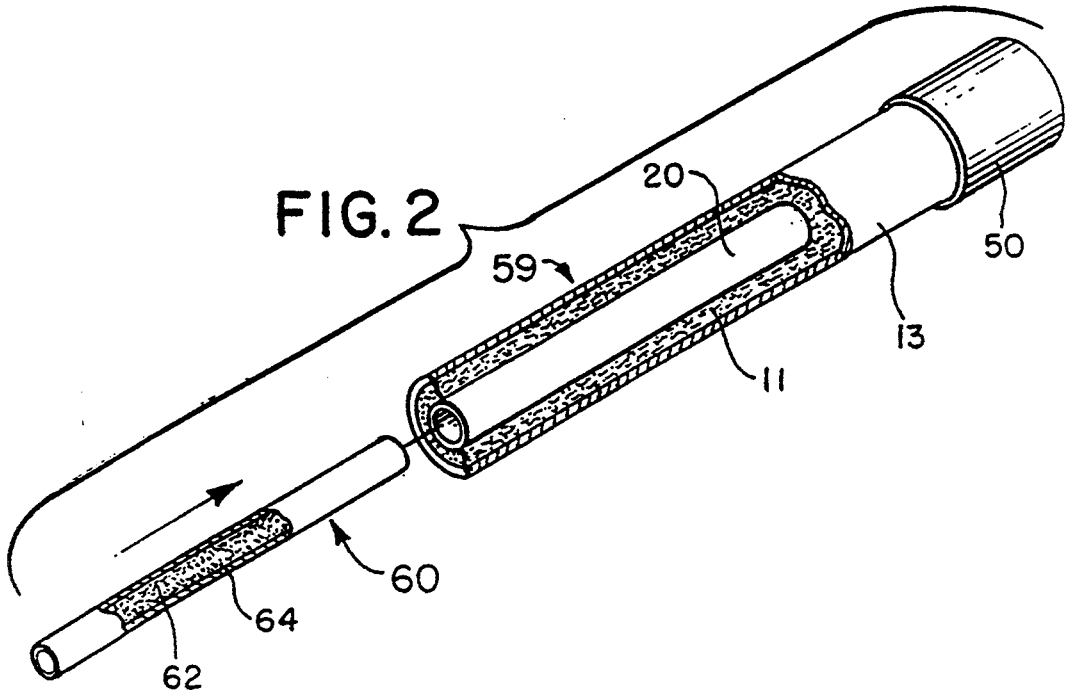
FIG. 2 is a prospective, exploded view of a cigarette similar to the cigarette shown in FIG. 1.

The cigarette 9 could also be configured to have the tobacco in the center and the heat source surrounding it, as shown in FIGS. 2 and 2A of U.S. Pat. No. 4,938,236, hereby incorporated by reference.

The cigarette 59 shown in FIG. 2 is essentially like cigarette 9, and identical parts are numbered identically. The main difference is that the heat source 60 of the cigarette 59 includes an outer wrap 64, which may act as an electrolyte material surrounding the metallic agents 62. Heat source 60 will be discussed in more detail below. FIG. 2 shows how the heat source 60 fits into heat chamber 20.

Preferred heat sources of the present invention generate heat in the desired amount and at the desired rate as a result of one or more electrochemical interactions between components thereof, and not as a result of combustion of components of the heat source. As used herein, the term "combustion" relates to the oxidation of a substance to yield heat and oxides of carbon. See, Baker, *Prog. Ener. Combust. Sci.*, Vol. 7, pp. 135–153 (1981). In addition, preferred non-combustion heat sources of the present invention generate heat without the necessity of the presence of any gaseous or environmental oxygen (i.e., in the absence of atmospheric oxygen).

Preferred heat sources generate heat rapidly upon initiation of the electrochemical interaction of the components thereof. As such, heat is generated to warm the tobacco to a degree sufficient to volatilize an appropriate amount of flavorful components of the tobacco rapidly after the smoker has initiated use of the cigarette. Rapid heat generation also assures that sufficient volatilized tobacco flavor is provided during the early puffs. Typically, heat sources of the present invention include sufficient amounts of components which interact to heat at least a portion of the tobacco to a temperature in excess of 70° C., more preferably in excess of 80° C., within about 60 seconds, more preferably within about 30 seconds, from the time that the smoker has initiated use of the cigarette.

Preferred heat sources generate heat so that the tobacco is heated to within a desired temperature range during the useful life of the cigarette. For example, although it is desirable for the heat source to heat at least a portion of the tobacco to a temperature in excess of 70° C. very rapidly when use of the cigarette is initiated, it is also desirable that the tobacco experience a temperature of less than about 180° C., preferably less than about 150° C., during the typical life of the cigarette. Thus, once the heat source achieves sufficient rapid heat generation to heat the tobacco to the desired minimum temperature, the heat source then generates heat sufficient to maintain the tobacco within a relatively narrow and well controlled temperature range for the remainder of the heat generation period. This temperature range is preferably maintained for at least 4 minutes, more preferably 8 minutes, and most preferably longer. Typical temperature ranges for the life of the cigarette are between about 70° C. and about 180° C., more preferably between about 85° C. and about 120° C., for most cigarettes using heat sources of the present invention. Control of the maximum temperature exhibited by the heat source is desired in order to avoid thermal degradation and/or excessive, premature volatilization of the flavorful components of the tobacco and added flavor components that may be carried by the tobacco.

The heat source may come in a variety of configurations. In each instance, the heat source includes at least two metallic agents which can interact electrochemically. The individual metallic agents can be pure metals, metal alloys, or other metallic compounds.

The metallic agents may be simply a mixture of powders. However, preferred configurations of the metallic agents include mechanically bonded metals (sometimes referred to as mechanical alloys), frozen melts of the metallic agents, bimetallic foils and electrically connected wires. With respect to mechanical alloys, frozen melts, and sometimes even with bimetallic foils, the mechanical agents generally are formed into small particles that are later compressed or extruded, or packed in a tube, to form the heat source 35 or 60.

Each of the preferred heat source configurations uses one of the metallic agents as an anode in an electrochemical interaction and another metallic agent as a cathode. For this to happen, the metallic agents must be in electrical contact with one another. Each of the configurations also uses an electrolyte. In some embodiments, the electrical contact between the metallic agents could be through the electrolyte. A preferred anode material is magnesium, which reacts with water to form magnesium hydroxide ($Mg(OH)_2$) and hydrogen gas, and generates large amounts of heat. Other metallic agents having high standard oxidation potentials (such as lithium) may also serve as the anode material, but are less preferred from a cost and safety standpoint. The second metallic agent acts as a cathode to speed up the reaction of the anode material. The cathode may be any metallic agent having a lower standard oxidation potential than the anode material. The cathode is not consumed in the electrochemical interaction, but serves as a site for electrons given up by the corroding anode to neutralize positively charged ions in the electrolyte.

Some preferred metallic agents for use in the heat sources of the present invention include iron, copper, nickel, palladium, silver, gold, platinum, carbon, cobalt, magnesium, aluminum, lithium, $Fe_2O_3$, $Fe_3O_4$, $Mg_2Ni$, $MgNi_2$, $Mg_2Ca$, $MgCa_2$, $MgCo_2$, and combinations thereof. For example, platinum may be dispersed on carbon and this dispersion used as a cathode material.

Figure 3:
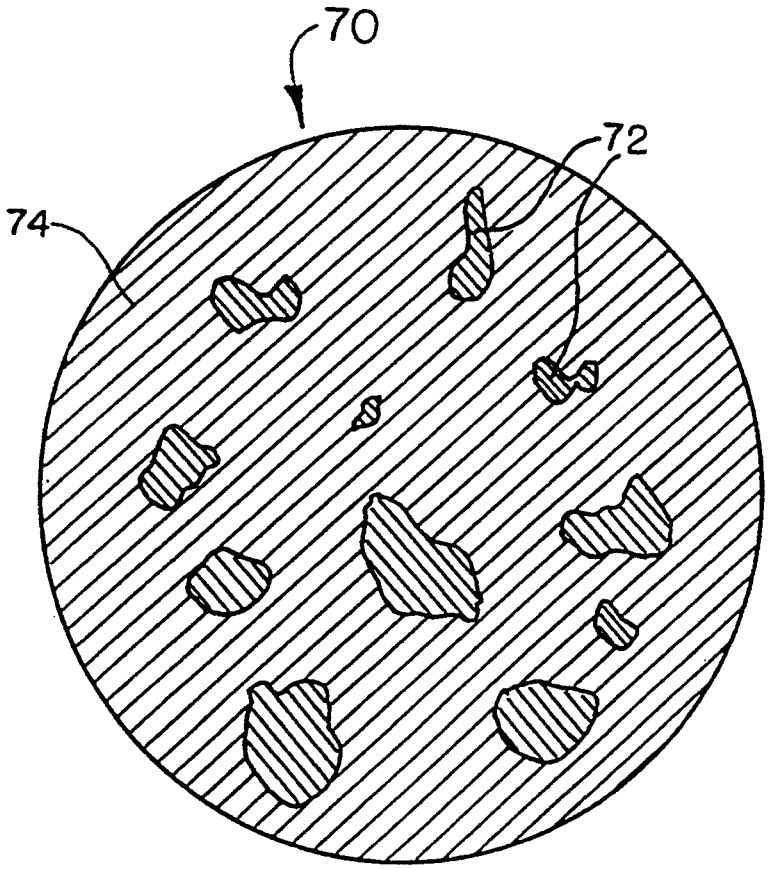
FIG. 3 is a schematic representation of one embodiment of metallic agents capable of interacting electrochemically with one another for use in the cigarettes of FIGS. 1 and 2.
Figure 3A:
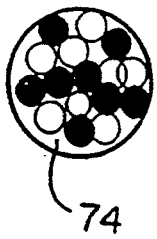
FIG. 3*a* is a schematic representation of an enlarged section of FIG. 3.

A frozen melt 70 is shown schematically in FIG. 3. The melt is prepared by heating the metallic agents until both are melted, and then cooling the melt until it is solid. With some metallic agents, the frozen melt will constitute a multiphase alloy, such as when two metallic agents are not very soluble with one another. Also, in preferred frozen melts, one metallic agent is provided in a concentration such that it precipitates as large crystalline grains 72 in the matrix of smaller eutectic solids 74. FIG. 3*a* shows an enlarged section of the eutectic matrix 74 depicting crystallites of the individual metallic agents. In preferred embodiments, the grains 72 will be more predominant than shown in FIG. 3, making up the majority of the frozen melt.

One suitable system for forming such a frozen melt is magnesium and nickel. In concentrations of less than about 11.3 atomic percent nickel, as the melt cools, magnesium will precipitate out, raising the nickel concentration of the remaining liquid. At about 11.3 atomic percent nickel, further cooling results in a eutectic of magnesium crystallites and $Mg_2Ni$ crystallites. For this system, the grains 72 shown in FIG. 3 would be magnesium and the matrix 74 would be $Mg_2Ni$ and magnesium crystallites. The size of the grains 72 would depend on the amount of magnesium present in the original melt and the cooling conditions.

Other cathode materials that are preferred for forming a frozen melt with magnesium include iron, copper, and cobalt, although gold, silver, palladium, or platinum may also be used. Of course other cathode materials besides magnesium may be used. Any metallic agents that can be melted together, or physically mixed together while melted, may be used, though some systems that do not form solutions may be hard to work with. It is not necessary for the system to form a eutectic. Also, it is preferable to use melts that are predominantly the metallic agent which will serve as the anode in the electrochemical interaction, such as magnesium in the magnesium-nickel system, since the cathode is not consumed. A preferred frozen melt can be made from 96% magnesium and 4% nickel, resulting in a solid comprising 85% magnesium grains and 15% of a eutectic of $MgNi_2$ and magnesium crystallites.

The frozen melt is preferably formed into small particles to increase the surface area. FIG. 4 shows two preferred methods for forming small particles and the heat source. The metallic agents are first melted to form a liquid melt. In the case of magnesium-nickel melts, the melt temperature is about 800° C. The melt can then either be cast into ingots and milled to small particles, or the molten alloy may be atomized, with individual droplets cooling to form the frozen melt 70 represented by FIG. 3. The atomizing step can be performed by a variety of standard metallurgical processes for forming small spherical particles from a molten melt. In the preferred large scale process, the magnesium alloy is sprayed into an inert atmosphere (argon) in a large vessel which permits the droplets to freeze before contacting the side of the vessel. The size of the particles can be controlled by atomization conditions. A second process, know as rotating electrode powder preparation, is a smaller scale process suitable for laboratory production of powder. In this process, an electrode is fabricated from the desired alloy and the electrode is placed in a rotating chuck within an enclosed chamber. The chamber is purged with argon and evacuated by mechanical pumping. Electrical sparks are generated between the electrode and an electrical ground. The sparks melt the alloy at a local point and the droplet of molten metal is spun from the surface by centrifugal force. The droplet cools during its trajectory and is collected. The preferred particle size of the frozen melt particles is in the range of 50–400 microns, most preferably 100–300 microns.

Figure 7:
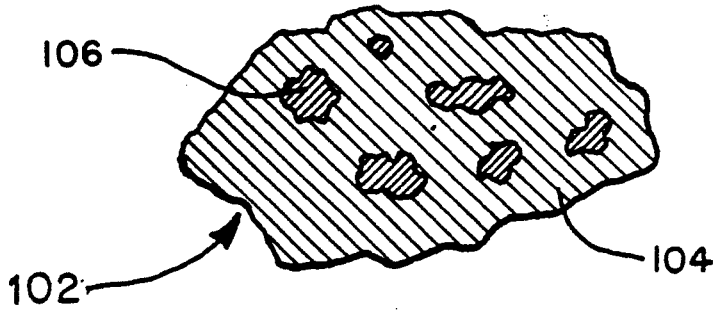
FIG. 7 is an enlarged elevational view of another embodiment of a heat source for the cigarette of FIG. 1.

FIG. 7 shows yet another embodiment of the metallic agents used to form heat source 35 or 60. In this embodiment, small particles 102 of a "mechanical alloy" are prepared by mechanically bonding or cold welding together small particles of the separate metallic agent. Preferably, the area of contact of the metallic agents is very high. The metallic agent that will serve as the anode is the most predominant in particles 102 and forms the background 104 of the particle. The metallic agent that will serve as the cathode is present as distinct specks 106 in the background 104.

Preferably, the anode material 104 is magnesium and the cathode specks 106 comprise iron. This type of material can be purchased from Dymatron Inc., 2085 Fallon Road, Lexington, Ky. 40504. The powder is reportedly made by ball-milling coarse magnesium powder with very fine iron powder in a vibrating mill. The powder blend used is 10% iron and 90% magnesium. Steel balls (0.25-inch diameter) are added to the powder blend, and the blend and the balls are reportedly vibrated for a period of about 15 minutes. U.S. Pat. Nos. 4,017,414 and 4,264,362 disclose processes for making such magnesium-iron mechanical alloys.

Preferably the mechanical alloy is screened to obtain desired particle sizes before it is used in the present invention. It has been found that in materials procured from Dymatron, Inc., only about half of the iron powder is embedded in the surface of the magnesium, the rest remains as fine iron powder. The powder as received from Dymatron also has a very broad particle size distribution. The powder is preferably sized on a standard screener using screen sizes of 16, 30, 40, 50, 80, 140 U.S. mesh. The portion that passes through the 50-U.S. mesh screen and stays on the 80-mesh screen is generally used, as it produces heat sources with the longest life at temperatures above 100° C. If a faster heating rate is desired, 10 or 20% of the total powder used may be a finer cut of powder (through 80-U.S. mesh screen, on the 140-U.S. mesh screen). The iron content of these cut powders are generally 6–7%. The unbound iron passes through the 140-U.S. mesh screen and is collected on the pan.

After particles of the proper size of either the frozen melt or the mechanical alloy are obtained, they may be used to create a heat source 35 or 60. One method of forming a heat source is to extrude the particles of frozen melt with a binder into an extruded rod, which is then severed into the proper length to form a heat source 35. Cylindrical, square, annular and even star-shaped extrusions may be formed. A binder such as sodium carboxymethyl cellulose (CMC) may be used to extrude the metallic agents. A level of about 6% binder in the extrudate has been found to hold the metallic agents into the proper shape.

Extrusion is complicated by the fact that water typically used in extruding powders will initiate the electrochemical interaction of the heat source particles. A preferred extrusion process uses low amounts of deionized water, and several other precautions to limit this problem. First, all of the ingredients and equipment are preferably cooled prior to the extrusion process. Second, it has been found that a small amount of heptane may be used to coat the powder particles prior to mixing the powder with CMC and water for the extrusion. Third, the extruder parts are preferably made of brass to reduce the possibility of sparking, and the equipment should be grounded.

Preferably the CMC is first mixed with deionized water to form a gel. A preferred ratio is 12 parts water to 1 part CMC. The powder/heptane ratio is preferably 20:1. The CMC gel and treated powder are preferably chilled before mixing. A Sigma blade mixer built to allow cooling with a liquid during mixing, such as the small Sigma blade mixer sold by C. W. Braybender Instruments Company, South Hakensak, N.J., has been found to give good results. The treated powder is preferably added to the pre-chilled (about 4° C.) mixer first and the CMC gel is slowly added and worked into the powder, using a slow blade speed, preferably about 8 RPM. The temperature should be monitored during the mixing, which may take up to an hour or more. Normally the temperature will rise a few degrees. If the temperature increases 15°–20° C., the product should be emptied from the mixer, since the temperature rise indicates an excessive reaction is taking place and the mix will not be usable, and continued mixing may be dangerous.

The extruder should also be prechilled, and the mixed material charged to the extruder with a minimum of handling. The forming die will vary depending on the size of the heat source being made. For 60 mm heat sources, a 0.130 inch die has been found appropriate, while 55 mm heat sources have been made with a 0.136 inch die. The extruder may be as simple as a tube and plunger. For example, a FORNEY compression tester has been used to supply extrusion pressure for a ram in a one inch diameter tube.

Preferably the die will be pointing down so that the extrudate can be caught on a plastic sheet taped onto a conveyor belt and removed in a horizontal position. The belt speed and extrusion speed should be controlled to obtain good results. Pressure in the extruder will preferably be increased in small increments, as over pressurizing may cause separation of the powder and CMC gel. A ram speed of about 0.3 to 0.5 inches per minute, with a load of about 70 pounds, has been found useful for an extrusion tube having an inside diameter of one inch.

After the extrudate is extruded out on the conveyor belt, it should be allowed to partially dry before it is handled. After about 30 minutes of drying, the extrudate can be cut into strips about 24 inches long and put onto drying racks. The strips should be allowed to dry at room temperature overnight, and may be cut to size the following morning. The cut rods may then be heated to 60° C. in a vacuum oven (preferably explosion-proof) overnight to remove the heptane. The dried rods are then ready for assembly into smoking articles.

The metallic agents may also be pressed into desired shapes. Two methods of pressing are contemplated, die pressing and isostatic pressing. Die pressing magnesium-based heat source particles is difficult because of the tendency of magnesium to smear and reduce the porosity on the surface of the rod. To make a successful rod it is preferable to press the rod in a horizontal position. The die should be designed to release the part without any stripping action, which causes galling. A preferred die cavity is 0.090 inches wide and 3 inches long. The depth may be varied as necessary to produce a part of a desired weight and thickness. However, difficulties in filling such a long narrow cavity uniformly have been found to produce variable densities within the rod.

It is believed that isostatic pressing would produce parts of uniform density without galling and with uniform density.

The material may need to have a binder or extender added to produce a heat source with a proper rate of reaction. Also, the porosity (or void fraction) and pore size may be varied to help control the rate of reaction. Polysulfone, a high temperature plastic from Amoco, and CMC are possible binders. Magnesium and, less preferable because of its weight, aluminum, may be used as extenders. The porosity is primarily controlled by the pressure used. The pore size is primarily controlled by the particle size.

An additional extender is NaCl. The NaCl may be used to provide porosity, as it will dissolve to form an electrolyte when the pressed rod is contacted by water. However, rods produced with NaCl may be hygroscopic, and may therefore need to be stored in controlled humidity environments.

A preferred material for making pressed rods comprises an intimate mixture of 48% magnesium (−325 mesh), 32% of a −30 mesh, +40 mesh cut of mechanically bonded magnesium and iron from Dymatron, Inc., and 20% NaCl ground to a small particle size. A preferred pressure for pressing such a mixture is 14,800 psi.

Another method of using the particles of metallic agents is to fill a preformed straw or tube with the particles to form a heat source 60, with the wall of the straw forming the outer wrap 64. The straw may be plastic, metal or even paper. Of course, the particles need to be secured in the straw so that they do not fall out prior to use.

One preferred embodiment of such a preformed straw 76 is shown in FIG. 10. The powder 75 is contained in a plastic straw 77 having small holes 78 formed in the sides for migration of the electrolyte. The ends 79 of the straw 77 are sealed.

FIG. 5 illustrates another configuration of a heat source formed from a bimetallic foil 80. The bimetallic foil 80 is formed with the metallic agent that will be corroded (the anode) forming a first or primary layer 82. A second metallic agent (the cathode) is applied in a thin film to the first layer to form a second layer 84. This thin, second layer 84 may preferably be formed by sputter coating. A preferred bimetallic foil 80 comprises a magnesium primary layer 82 about 4 mils thick, and a sputter coated iron second layer 84 about 0.1 micron thick. The bond between the first and second layers 82 and 84 can be formed in other ways, so long as the first and second layers 82 and 84 are in electrical contact with one another.

The bimetallic foil 80 may be formed into a heat source in several ways. A preferred method is to roll the foil 80 into a roll 88. When this method is used, an absorbent material such as tissue paper 86 may be rolled interspaced with the foil 80 as shown in FIG. 5*a*. The absorbent paper then helps to convey water into the inside layers of the foil for use in the electrochemical interaction. As shown in FIG. 5*b*, the roll 88 may then be inserted into a heat chamber 20. Alternatively, the foil 80 can be chopped into fine shreds and either extruded with a binder, pressed into a rod or used to fill a straw, just as with the particles of frozen melt or mechanical alloy discussed above.

Figure 6:
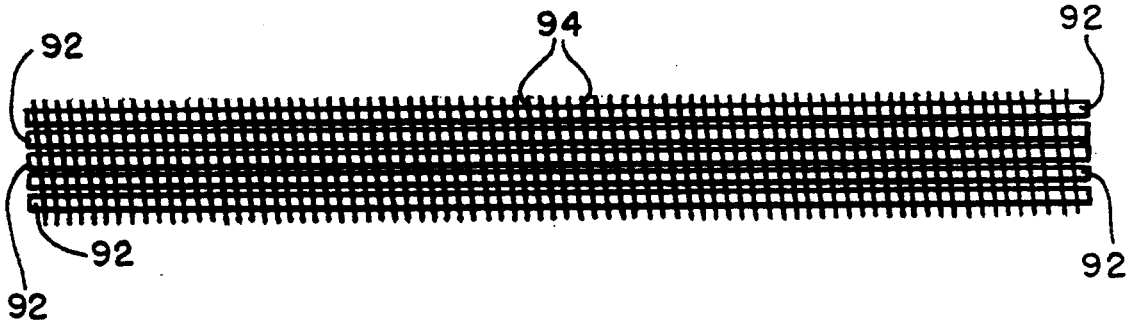
FIG. 6 is a schematic representation of another embodiment of metallic agents capable of interacting electrochemically with one another.

Yet another possible configuration of the heat source 35 is depicted in FIG. 6. In this embodiment, the anode material is formed into strands 92 and the cathode material is formed into a fine wire 94. The wire 94 can then be wrapped around the strands 92 to put the wire 94 in close proximity to the strands 92. In this embodiment, the wire 94 must be in electrical contact with strands 92. Since the strands 92 will corrode during the electrochemical interaction, it is preferably to protect at least one area of the electrical contact from interaction so that the electrical contact is not lost. One simple method to do this is to crimp the wire 94 and strands 92 together at one end and coat the crimped end with a protective coating material impervious to the electrolyte used in the electrochemical interactions. The diameter of the strands is important to obtain a sufficient surface area. In this embodiment, the strands 92 are preferably magnesium and the wire 94 is preferably iron. When magnesium is used to form the strands 92, each strand is preferably 0.2 inches in diameter. The wire 94 need only be thick enough to provide physical integrity, since the wire does not corrode. However, the surface area of the strands 92 and wire 94 are preferably approximately equal. In the preferred embodiment of FIG. 6, the iron wire 94 is 0.001 inches in diameter. The embodiment of FIG. 6 may preferably be constructed by twisting the strands 92 together before wrapping them with wire 94.

Normally, each heat source comprises about 100 mg to about 400 mg of metallic agents. For heat sources which include a mixture of magnesium and iron, the amount of magnesium relative to iron within each heat source ranges from about 100:1 to about 4:1, most preferably 50:1 to 16:1. Other metallic agents would use similar ratios.

The electrolyte can vary. Preferred electrolytes are the strong electrolytes. Examples of preferred electrolytes include potassium chloride, sodium chloride, and calcium chloride. The electrolyte can be provided in a dry state with the metallic agents and formed into the heat source, or can be supplied as a saline solution to initiate the electrochemical interaction. When the electrolyte is mixed with the metallic agents, each heat source will normally comprise about 5 mg to about 150 mg electrolyte. Alternatively, when the electrolyte is provided with water in a saline solution, the electrolyte will preferably be dissolved at a level of about 1% to about 20% of the solution.

Figure 8:
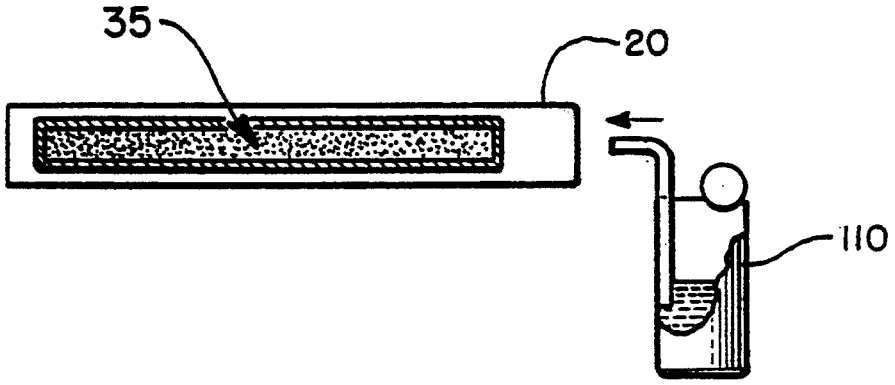
FIGS. 8 and 9 are schematic representations of two alternative methods of initiating an electrochemical reaction in the cigarettes of FIGS. 1 and 2.
Figure 9:
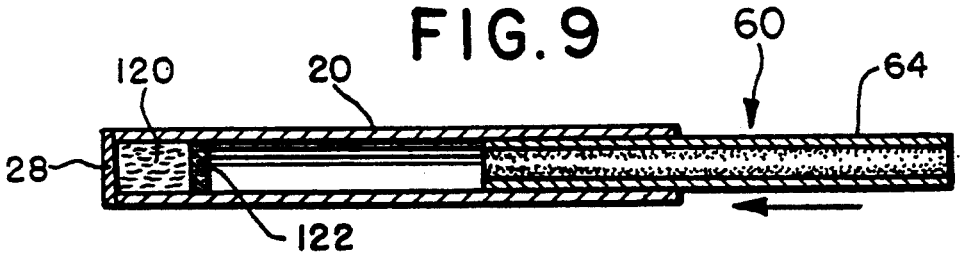

A solvent for the electrolyte is employed to dissociate the electrolyte (if present in the heat source), and hence initiate the electrochemical interaction between the metallic agents. The preferred solvent is water. The pH of the water can vary, but typically is about 6 or less. Contact of water with the components of the heat source can be achieved in a variety of ways. For example, as depicted in FIG. 8, the heat source 35 can be present in a heat chamber 20 in a dry state. Water can then be injected into the heat source from a hand-held and hand-operated pump 110 when activation of the heat source 35 is desired. Preferably, the plug 38 (FIG. 1) used in such a configuration will provide a port for injecting the water. Alternatively, as depicted in FIG. 9, liquid water can be contained in a container inside the heat chamber 20 but separate from the heat source, such as a rupturable capsule 120. The capsule can be formed by the walls of the heat chamber 20 and the end 28 thereof and a frangible seal 122 which is ruptured when contact of the water with the heat source 60 is desired. The frangible seal 122 may preferably be made of wax or grease.

In either embodiment, water can be supplied to the portion of the heat source distant from the source of the water by using a porous wick. The absorbent material 86 interspaced in the bimetallic foil roll 88 serves this function. The outer wrap 64 on heat source 60 may also provide this wicking action to the metallic agents 62 inside. Normally, each heat source is contacted with about 0.25 ml to about 0.6 ml water, most preferably about 0.45 ml. As noted above, the water in the pump 110 or capsule 120 may contain the salt to be used as the electrolyte if the electrolyte is not present in the heat source initially.

Preferred heat sources or solutions applied thereto include an oxidizing agent, such as calcium nitrate, sodium nitrate or sodium nitrite. For example, for preferred heat sources containing magnesium, hydrogen gas, which results upon the hydroxylation of magnesium, can be exothermically oxidized by a suitable oxidizing agent. Normally, each heat source or solution applied thereto comprises up to about 150 mg oxidizing agent. The oxidizing agent can be encapsulated within a polymeric material (e.g., microencapsulated using known techniques) in order to minimize contact thereof with the metallic agents (e.g., magnesium) until the desired time. For example, encapsulated oxidizing agent can increase the shelf life of the heat source; and the form of the encapsulating material then is altered to release the oxidizing agent upon experiencing heat during use of the heat source.

Unless the particles of metallic agents by their size and shape provide physical spacing, the heat source preferably includes a dispersing agent to provide a physical spacing of the metallic agents. Preferred dispersing agents are essentially inert with respect to the electrolyte and the metallic agents. Preferably, the dispersing agent has a normally solid form in order to (i) maintain the metallic agents in a spaced apart relationship, and (ii) act as a reservoir for the electrolyte solution. Even where a dispersing agent is not needed for spacing, it may be used as a water retention aid.

Examples of normally solid dispersing agents or water retention aids are porous materials including inorganic materials such as granular alumina and silica; celite; carbonaceous materials such as finely ground graphite, activated carbons and powdered charcoal; organic materials such as wood pulp and other cellulosic materials; and the like. Generally, the normally solid dispersing agent ranges from a fine powder to a coarse grain or fibrous size. The particle size of the dispersing agent can affect the rate of interaction of the heat generating components, and therefore the temperature and longevity of the interaction. Although less preferred, crystalline compounds having chemically bound water molecules can be employed as dispersing agents to provide a source of water for heat generation. Examples of such compounds include potassium aluminum dodecahydrate, cupric sulfate pentahydrate, and the like. Normally, each preferred heat source comprises up to about 150 mg normally solid dispersing agent.

The electrolyte or heat source preferably includes an acid. The acid provides hydrogen ions, which are capable of enhancing the rate of the electrochemical reaction. Also, the acid is used to maintain the pH of the system below the point where the oxidizing anode reaction is impeded. For example, when the anode comprises magnesium, the system will become more basic as the reaction proceeds. However, at a pH of about 11.5, the $Mg(OH)_2$ forms a passive coating preventing further contact between the electrolyte solution and unreacted magnesium. The acid may be present in the form of a solution with the electrolyte, provided on a solid support, or mixed with the electrolyte solution to form a slurry. The solid and slurry may be preferable as the acid may then dissolve over time and provide a constant stream of hydrogen ions. The acid may preferably be malic acid. Other acids, such as citric and lactic acid may also be used. The acid chosen must not react with the electrolyte. Also, the acid should not be toxic, or produce unpleasant fumes or odors. Also, the acid may have an effect on the overall reaction rate, and should thus be chosen accordingly.

Although not preferred, the heat source or the solution applied thereto may also include a phase change or heat exchanging material. Examples of such materials are sugars such as dextrose, sucrose, and the like, which change from a solid to a liquid and back again within the temperature range achieved by the heat source during use. Other phase change agents include selected waxes or mixtures of waxes. Such materials absorb heat as the interactant components interact exothermically so that the maximum temperature exhibited by the heat source is controlled. In particular, the sugars undergo a phase change from solid to liquid upon application of heat thereto, and heat is absorbed. However, after the exothermic chemical interaction of the interactive components is nearly complete and the generation of heat thereby decreases, the heat absorbed by the phase change material can be released (i.e., the phase change material changes from a liquid to a solid) thereby extending the useful life of the heat source. Phase change materials such as waxes, which have a viscous liquid form when heated, can act as dispersing agents also. About 150 mg of phase change material may be used with each heat source.

The electrolyte solution may include a boiling modifier such as glycerin to prevent the water from vaporizing at temperatures experienced by the heat source. Other boiling modifiers include triethylene glycol and 1-3-propane diol. Also, the outerwrap 64 of the heat source may act as a surface on which steam generated by the electrochemical interaction can condense.

The relative amounts of the various components of the heat source can vary, and often is dependent upon factors such as the minimum and maximum temperature desired, the time period over which heat generation is desired, and the like. An example of a suitable heat source includes about 200 mg magnesium metal particles, about 50 mg iron metal particles, about 50 mg crystalline potassium chloride, about 100 mg crystalline sodium nitrate and about 100 mg cellulose particles; which are in turn contacted with about 0.2 ml liquid water. A more preferred heat source includes 0.4–0.5 grams extruded or pressed metallic agents, comprising 6% CMC and 94% alloy, which is 6% iron and 94% magnesium. This is preferably contacted by 0.45 ml of an electrolyte solution containing 20% NaCl, 10% $Ca(NO_3)_2$, 5% glycerin and 1% malic acid.

To control the rate of the electrochemical interaction, the anode material, particularly magnesium, may be pretreated. For example, it has been found that some mechanical alloys from Dymatron, Inc. reacted very quickly but cooled off sooner than desired. It was discovered that if additional electrolytes were added to these previously reacted powders, they would heat up again, though not as quickly as at first, and maintain a high temperature for a longer time. A mixture of pretreated and untreated powders was thus prepared and found to have good initiation characteristics and maintained high temperatures for sufficient durations. A preferred pretreating process involves contacting the particles with a limited amount of acid solution and allowing the reaction to heat up and drive off the water, thus terminating the reaction. One particularly preferred pretreating process uses 0.34 ml of 12N HCl acid diluted with 54.67 ml of water and 100 grams of mechanical alloy from Dymatron, Inc. screened to remove particles passing through a 28 US mesh screen. After reacting with the acid, the pretreated particles are preferably dried under a vacuum at 120° C. for 2½ hours.

Cigarettes made with heat sources of the present invention incorporate some form of tobacco. The form of the tobacco can vary, and more than one form of tobacco can be incorporated into a particular smoking article. The type of tobacco can vary, and includes flue-cured, Burley, Md. and Oriental tobaccos, the rare and specialty tobaccos, as well as blends thereof.

Any form of tobacco may be used herein. For example, tobacco cut filler (e.g., strands or shreds of tobacco filler having widths of about 1/15 inch to about 1/40 inch, and lengths of about ¼ inch to about 3 inches). Tobacco cut filler can be provided in the form of tobacco laminae, volume expanded or puffed tobacco laminae, processed tobacco stems including cut-rolled or cut-puffed stems, or reconstituted tobacco material. Processed tobaccos, such as those described in U.S. Pat. No. 5,025,812 to Fagg et al., and U.S. patent application Ser. No. 484,587, filed Feb. 23, 1990, now U.S. Pat. No. 5,065,775, can also be employed.

Although the roll or charge of tobacco can be employed as cut filler, other forms of tobacco are preferred. One particularly preferred form of tobacco useful herein is tobacco paper. For example, a web of tobacco paper available as P2831-189-AA-6215 from Kimberly-Clark Corp. may be used.

Another form of tobacco useful herein is finely divided tobacco material. Such a form of tobacco includes tobacco dust and finely divided tobacco laminae. Typically, finely divided tobacco material is carried by a substrate.

Another form of tobacco useful herein is tobacco extract. Tobacco extracts typically are provided by extracting a tobacco material using a solvent such as water, carbon dioxide, sulfur hexafluroide, a hydrocarbon such as hexane or ethanol, a halocarbon such as a commercially available Freon, as well as other organic and inorganic solvents. Tobacco extracts can include spray dried tobacco extracts, freeze dried tobacco extracts, tobacco aroma oils, tobacco essences, and other tobacco extracts. Methods for providing suitable tobacco extracts are set forth in U.S. Pat. Nos. 4,506,682 to Mueller and 4,986,286 to Roberts et al.; European Patent Publication Nos. 326,370 and 338,831; U.S. applications Ser. No. 536,250 filed Jun. 11, 1990; Ser. No. 452,175 filed Dec. 18, 1989 (now U.S. Pat. No. 5,060,669); and Ser. No. 680,207 filed Apr. 4, 1991.

Also useful are flavorful tobacco compositions such as those described in U.S. Pat. No. 5,016,654 to Bernasek et al. Extruded tobacco materials (made by processes such as those described in U.S. Pat. No. 4,821,749 to Toft et al.) can also be used.

When tobacco extracts are employed, such extracts normally are carried by a substrate such as tobacco materials (e.g. reconstituted tobacco and tobacco laminae). Reconstituted tobacco material can be provided using cast sheet techniques; papermaking techniques, such as described in U.S. Pat. Nos. 4,962,774 to Thomasson et al. and 4,987,906 to Young et al. Reconstituted tobacco materials may include fillers, such as calcium carbonate, carbon and alumina. Processed tobaccos, such as tobaccos treated with sodium bicarbonate or potassium carbonate, which readily release the flavorful components thereof upon the application of heat thereto are particularly desirable. Normally, the weight of the tobacco within the cigarette ranges from about 0.2 g to about 1 g.

To help release the volatile tobacco flavors, it is preferable to apply tobacco extracts and flavors on an alkaline porous material. One example of a preferred alkaline porous material in the form of reconstituted tobacco sheets is made as follows. APC carbon (Calgon Corporation, Pennsylvania) is deactivated to a temperature appropriate for the flavor to be released, generally in the range of 1800° C. to 2500° C., for two hours under nitrogen. The heat-treated carbon is then pulverized and sieved. Preferably the powder that passes through a 100 U.S. mesh screen is collected and used.

Next, fibrillated tobacco is preferably mixed with 5 to 20% by weight of thermally deactivated APC carbon powder and 10 to 20% by weight of well refined wood pulp and 300 ml of water, blended for one minute at high speed in a household-type Osterizer blender. The mixture may then be poured into an 8" by 8" mold having a 100 mesh (U.S.) screen and containing 3 liters of water. The slurry may be gravity drained and the resulting sheet transferred to a conventional flat bed dryer, preset at 150° C., and dried until the moisture content is below 2%.

Similar sheets may be made with powdered alpha alumina, zeolite, graphite carbon or precipitated calcium carbonate. Tobacco sheets containing either alumina, deactivated carbon or calcium carbonate have been found to release a significantly higher amount of volitizable tobacco flavors than tobacco or tobacco sheets not containing fillers.

Flavoring agents such as menthol, vanillin, cocoa, licorice, cinnamic aidehyde, and the like; as well as tobacco flavor modifiers such as levulinic acid, can be employed. Such flavoring agents can be carried by the tobacco or positioned within the smoking article (e.g., on a separate substrate located in a heat exchange relationship with the heat source, or within the filter). If desired, substances which vaporize and yield visible aerosols can be incorporated into the smoking article in a heat exchange relationship with the heat source. For example, an effective amount of propylene glycol can be carried by the tobacco.

One particularly preferred method of collecting tobacco flavors for use with the present invention is described below and in more detail in U.S. patent application Ser. No. 07/800,680, filed Nov. 27, 1991, incorporated herein by reference. The method uses an apparatus as shown in FIG. 11. The apparatus used for the four extraction runs described below used a 250 ml round bottom flask 132 with a heating mantle 134 controlled by a powerstat 136. A thermocouple 139 and temperature recorder 138 were used to monitor and record the temperature in the flask 132. Nitrogen was supplied at a rate of 1 liter/minute from a tank 140 equipped with a flow meter 142. The nitrogen entered the flask 132 through a glass tube 144 and exited from a side arm adapter 145. The collection system included two 125 ml collection flasks (146 and 148) with exit tubes, each containing 20 g of propylene glycol 149 in the bottom of each flask. The nitrogen, containing the extracted flavors, was bubbled through the propylene glycol in each flask. Flask 146 was maintained at room temperature, and flask 148 was maintained at an ice bath temperature. Fiberglass insulation 150 was used to insulate the outlet to the round bottom flask 132. In runs two and four, a filter 152 was used on the exit tube of collection flask 148 to trap any uncollected extracts.

Extraction Run No. 1

Forty-five grams of freeze-dried flue cured tobacco was heat treated in the round bottom flask 132. The freeze drying was at 5–10 millitorr overnight at −8° C., reducing the moisture content to less than 1%. Heat was applied to the flask 132 in a staged manner that reached −~212° C. in 2 3/5 hours. After approximately five hours at this temperature, samples were pulled from collection flasks 146 and 148 and labeled (Samples 1 and 2). Another 20 g of propylene glycol was then put into each collection flask. The temperature was then increased to ~270° C. in ½ hours. Samples were then again removed from flasks 146 and 148 (Samples 3 and 4).

Extraction Run No. 2

Forty-five grams of freeze-dried Turkish tobacco was placed in the flask 134 and processed in the same manner as Run No. 1, except a double Cambridge filter was placed at the exit 152 of flask 148. In previous experiments, aerosol was observed at this exit. The Cambridge filter entrapped this material. The temperature increase at the thermocouple was staged to reach 216° C.±2° over 4.5 hours and held for 4 hours. The propylene glycol was removed from flasks 146 and 148 (Samples 5 and 6) and the temperature was increased. Fresh propylene glycol was added to clean collection flasks and the temperature was increased to 275° C.±5° in 1.25 hours. The Cambridge filter pads from the filters were extracted with 15 g propylene glycol at the same time as the fresh propylene glycol was added to flasks 146 and 148. Approximately 750 mg of material was collected on the pads. The 275° C. temperature was maintained for ~3.5 hours. At this time the propylene glycol from flasks 146 and 148 was again collected (Samples 7 and 8). Only 20 mg of material was collected on the Cambridge pads for the second phase of the run, which was probably due to a build up of solid material between flask 146 and flask 148. This solid material was washed into flask 148 (Sample 8).

Extraction Run No. 3

Another extraction run like Run No. 2 was made using freeze dried Burley tobacco, except that no ice-bath temperature trap (flask 148) or filter 152 were used. The first heating stage took 2 hours to reach 216° C., where the temperature was maintained for 3 hours, after which the flask 132 was stoppered and the system allowed to cool down overnight. The second heating stage took about 2.5 hours to reach a temperature of 325° C., and distillation was continued for 3 hours thereafter.

Extraction Run No. 4

Forty-five grams of freeze dried Latakia tobacco were placed in the distillation system shown in FIG. 11. The system was heated to 200° C. in ~4.5 hours and remained above 200° C. for ~3.5 hours. A large amount of oil-like material collected in the flask 146. The propylene glycol was therefore changed in the middle of the low temperature run. At the end of the 3.5 hours, samples were collected from both flasks 146 and 148, and the temperature was slowly increased over a period of about ~1.0 hour to 270°-275° C. Flask 132 then remained at this temperature for 3 hours and 45 minutes. Again, the propylene glycol in flask 146 was changed in the middle of the high temperature run. Listed below are the samples collected. A Cambridge filter was placed on the exit of flask 148. Material was eluted from the Cambridge filter (0.78 g) that collected during low temperature heating.

| Sample | Trap Description | Retort Temperature & Time |
|---|---|---|
| 9 | Flask 146 | Initial heating and 210° C. for 2 hours |
| 10 | Flask 146 | 210° C. between hours 2 and 4 |
| 11 | Flask 148 | Initial heating and 210° C. for ~4 hours |
| 12 | Cambridge Filter | Initial heating and 210° C. for ~4 hours |
| 13 | Flask 146 | Second stage heating and 275° C. for ~2 hours |
| 14 | Flask 146 | 275° C. between hours 2 and 3.5 |
| 15 | Flask 148 | Second stage heating and 275° C. for ~3.5 hours |
| 16 | Cambridge Filter | Second stage heating and 275° C. for ~3.5 hours |

The material from the Cambridge filter was contained in ~7.0 g propylene glycol.

After the various flavors were extracted, the samples were mixed and applied to reconstituted tobacco sheet. However, it was discovered that when the flavors from two or more types of tobaccos were mixed, and the tobacco sheet heated, the flavors were not released very well. However, when the mixture of samples from the same tobacco (such as Samples 5-8) were applied to a reconstituted tobacco sheet, the flavor released much better. This was found to be true even if several different tobacco sheets carrying sample mixtures from different tobaccos were used in segments in the same cigarette. Not wishing to be bound by theory, it is contemplated that in a mixture of flavors from different tobaccos, the vapor pressure of the various flavors are reduced, preventing the flavors from releasing as well as when they are present by themselves.

Preferred smoking articles of the present invention have a long shelf life. That is, during distribution and storage incident to commercial products, neither the flavor nor the heat source will lose their potency over time. Finally, when the product is ready for use, the smoker initiates exothermic interaction of the heat source 35 or 60 and the heat source generates heat. Heat which results acts to warm the tobacco which is positioned in close proximity to the heat source so as to be in a heat exchange relationship therewith. The heat so supplied to the tobacco acts to volatilize flavorful components of the tobacco as well as flavorful components carried by the tobacco. The volatilized materials then are drawn to the mouth-end region of the cigarette and into the smoker's mouth. As such, the smoker is provided with many of the flavors and other pleasures associated with cigarette smoking without burning any materials. The heat source provides sufficient heat to volatilize flavorful components of the tobacco while maintaining the temperature of the tobacco within the desired temperature range. When heat generation is complete, the tobacco begins to cool and volatilization of flavorful components thereof decreases. The cigarette then is discarded or otherwise disposed of.

The following examples are provided in order to further illustrate various embodiments of the invention but should not be construed as limiting the scope thereof. Unless otherwise noted, all parts and percentages are by weight.

EXAMPLE 1

A heat source is prepared as follows:

About 5 g of magnesium powder having a particle size of −40 to +80 U.S. mesh and about 5 g of iron powder having a particle size of −325 U.S. mesh are ball milled at low speed under nitrogen atmosphere for about 30 minutes. The resulting mixture of magnesium and iron is sieved through a 200 U.S. mesh screen, and about 6.1 g of +200 U.S. mesh particles are collected. The particles which are collected comprise about 5 parts magnesium and about 1 part iron. Then, about 300 mg of the collected particles are mixed with about 90 mg of crystalline potassium chloride and about 100 mg of finely powdered wood pulp. The wood pulp has a particle size of about 200 U.S. mesh. The resulting solid mixture is pressed under 33,000 p.s.i. using a Carver Laboratory Press to a cylindrical pellet having a diameter of about 7.6 mm and a thickness of about 10 mm.

The pellet is placed into an uninsulated glass tube having one closed end. The tube has a length of about 76 mm and an inner diameter of about 12 mm. Into the tube is charged 0.25 ml water. The heat source generates heat, and reaches 70° C. in about 2 minutes and 95° C. in about 4 minutes. The heat source then continues to generate heat at a temperature between about 85° C. and about 95° C. for about 30 minutes.

EXAMPLE 2

A heat source is prepared as follows:

About 200 mg of magnesium powder having a particle size of −40 to +80 U.S. mesh is mixed thoroughly with about 50 mg of iron powder having a particle size of −325 U.S. mesh. The resulting solid mixture is pressed under 33,000 p.s.i. using a Carver Laboratory Press to provide a pellet in the form of a cylindrical tube having a length of about 3.2 mm and an outer diameter of about 7.6 mm, and an axial passageway of about 2.4 mm diameter.

The pellet is placed into the glass tube described in Example 1. Into the tube is charged 0.2 ml of a solution of 1 part potassium chloride and 4 parts water. The heat source reaches 100° C. in about 0.5 minutes. The heat source continues to generate heat at a temperature between about 95° C. and about 105° C. for about 8.5 minutes.

EXAMPLE 3

A heat source is prepared as follows:

About 200 mg of magnesium powder having a particle size of −40 to +80 U.S. mesh is mixed thoroughly with about 50 mg of iron powder having a particle size of −325 U.S. mesh and about 100 mg wood pulp having a particle size of about 200 U.S. mesh. The resulting solid mixture is pressed under 33,000 p.s.i. using a Carver Laboratory Press to provide a pellet in the form of a cylindrical pellet having a length of about 3.8 mm and a diameter of about 7.6 mm.

The pellet is placed into the glass tube described in Example 1. Into the tube is charged 0.2 ml of a solution of 1 part potassium chloride and 4 parts water. The heat source reaches 100° C. in about 0.5 minutes. The heat source continues to generate heat, maintaining a temperature above 70° C. for about 4 minutes. Then, about 0.2 ml of a solution of 1 part sodium nitrate and 1 part water is charged into the tube. The heat source generates more heat, and reaches a temperature of 130° C. in about 5 minutes. The heat source then maintains a temperature of above 100° C. for an additional 4.5 minutes.

EXAMPLE 4

Magnesium wire having a diameter of 0.032 inches (0.081 cm) was cut into five strands, each about 1.97 inches (5 cm) in length, and twisted together. The twisted strands weighed 0.226 grams and had a calculated surface area of 6.38 $cm^2$. An iron wire having a diameter of 0.001 inches (0.003 cm), a length of 39.37 inches (100 cm), a calculated surface area of 0.80 $cm^2$, and weighing 0.004 grams was wrapped tightly around the twisted magnesium strands.

The wire assembly was placed in a plastic tube approximately 4 mm in diameter and 600 microliters of electrolyte containing 20% NaCl, 10% calcium nitrate, 5% glycerin, 1% malic acid, and 64% water were added. Thermocouples were inserted to monitor temperature. The temperature of the assembly increased very rapidly to 95° C. (less than 2 minutes) and maintained temperatures greater than 70° C. for ten minutes.

EXAMPLE 5

A melt of 96% magnesium and 4% nickel was prepared and cast into ingots. Theoretically the ingots contained 85% magnesium grains and 15% of a eutectic of magnesium and $Mg_2Ni$. An ingot was machined into fine filings. To achieve a suitable bulk density (about 0.5 $g/cm^3$), the filings were milled for one hour using ⅜-inch diameter steel balls. The resultant product, irregular flat platelets, was screened to a −50 to +80 U.S. mesh size. These particles were then extruded with 6% sodium carboxymethyl cellulose into a rod 3.5 mm in diameter. A 60 mm length of the rod, weighing 0.36 grams, was wrapped in two layers of 60×70 mm tissue papers and inserted into a mylar tube with an inside diameter of 0.203 inches and a sealed bottom. A 6 mm long plug was used to seal the top of the tube. An electrolyte was prepared with 20% NaCl, 5% glycerin, 10% calcium nitrate and 1% malic acid dissolved in water. Exactly 0.45 cc of electrolyte were injected into the bottom of the tube. For temperature measurements, the assembly was insulated with three wraps of laboratory-grade paper towel. The temperature inside the tube reached 100° C. in about 30 seconds and maintained a temperature of over 100° C. for more than 7 minutes. The maximum temperature reached was about 110° C.

EXAMPLE 6

Heat sources were extruded generally using the extrusion process and equipment described earlier. 2.7 g of CMC (Aqualon) were blended with 33 grams of deionized water in a small jar and placed on rotating rollers for several hours. The resulting gel was stored in a refrigerator to improve its shelf-life and to pre-cool it. 40.3 g of magnesium/iron mechanical alloy from Dymatron, Inc., screened to a particle size that passed through a 50 U.S. mesh screen but was retained on a 80 U.S. mesh screen, were placed in a small jar with 2 g of heptane. The jar was placed on rotary rollers for at least 15 minutes and then stored in the refrigerator.

A Braybender Sigma blade mixer was pre-cooled to 4° C. using ice water. The powder was added to the pre-chilled mixer, and CMC gel was worked into the powder by slowly adding the CMC gel. After the sample was mixed, extruded and dried, the CMC constituted 6% of the final extrudate.

Figure 12:
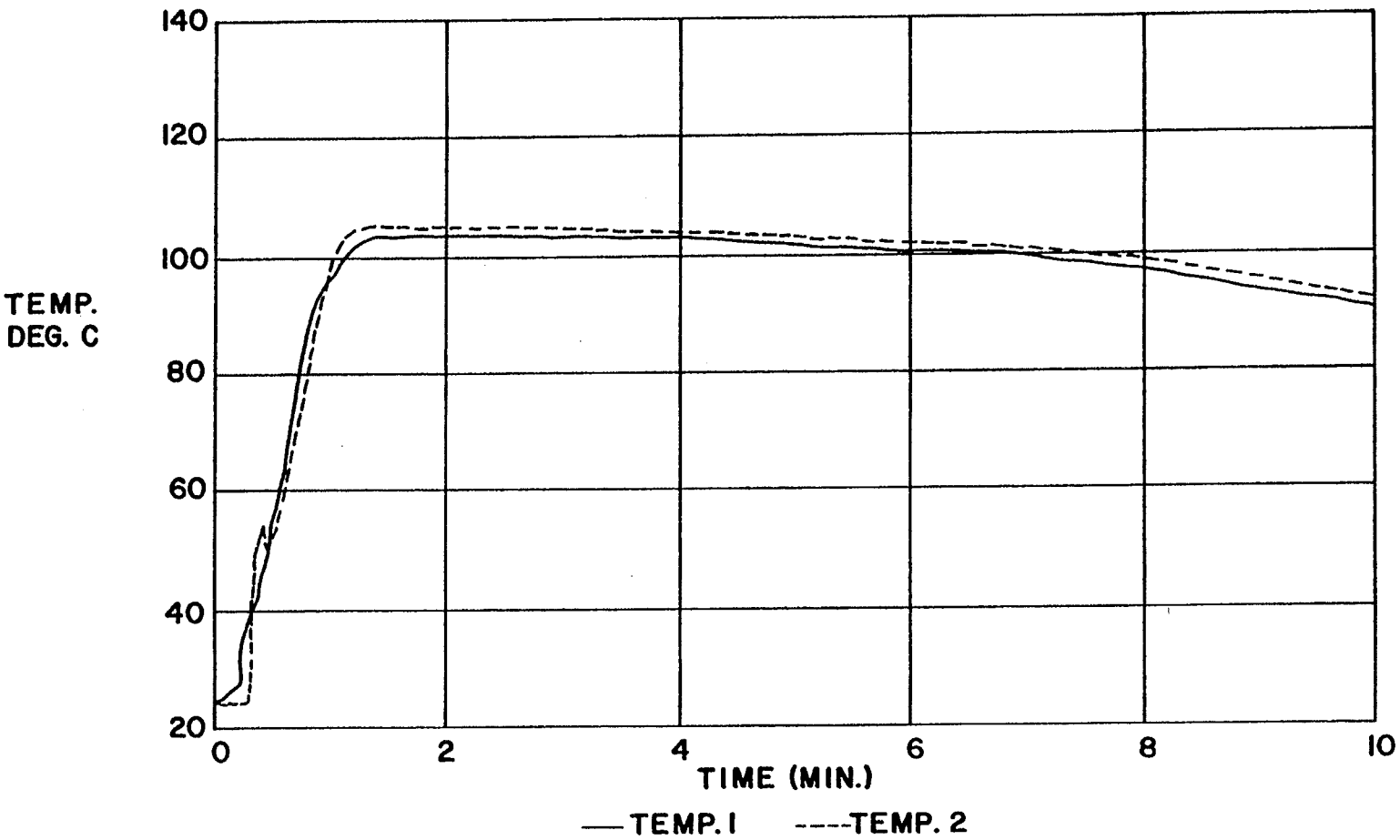
FIG. 12 is a graph showing the temperature with respect to time produced by a heat source produced by the present invention.

Six centimeter lengths of the extrudate were wrapped with 6×7 cm two-ply Kleenex facial tissue paper and held with Elmer's glue. A reaction chamber was prepared from a 7-cm segment of mylar tube (O.D. 208 inches) sealed at one end and containing 0.45 ml of aqueous electrolyte solution. The electrolyte solution contained 20% sodium chloride, 10% calcium nitrate, 5% glycerine and 1% malic acid. Reaction was initiated by inserting the wrapped heat source in the reaction chamber. Temperatures were measured by placing thermocouples between the chamber wall and the heat source at about 15 mm and 35 mm from the bottom. The assembly was insulated with three wraps of laboratory grade paper towel. The heat profiles generated are shown in FIG. 12. A +100° C. temperature was achieved in one minute. The temperature of the heat source remained above 95° C. for at least 7 min. Temperatures over 100° C. have been achieved in less than 30 seconds in this example by (a) incorporating 20–30 mg of −100 U.S. mesh mechanical alloy powder placed along the length of the extruded rod and wrapped with the tissue described above, (b) using finer particles of mechanical alloy in the extrusion, or (c) increasing the malic acid concentration to 2%.

EXAMPLE 7

Magnesium/iron alloy from Dymatron, Inc. was screened to pass through a 50 U.S. mesh screen, but be retained on an 80 U.S. mesh screen. The powder was about 6% iron. This material was then pretreated with acid using the process described earlier. Some of the same particle size powder that was not pretreated, the pretreated powder and Celatom FW-60 (Aldrich Chemical Company, Inc., Wisconsin) were mixed in the ratio of 8:8:7 by weight. A fuel rod like that shown in FIG. 10 was made in the following manner. A mylar tube with an external diameter of 0.208 inches was cut into 8 cm segments and one end was sealed by flame. The tube was perforated with four rows of 18-mil holes 5 mm apart. The tube was filled with about 500 mg of the powder/pretreated powder/Celatom mixture and the open end heat sealed, thus forming a perforated capsule about 6 cm long. Another 7 cm long mylar tube with an outer diameter of 0.212 inches with one end heat sealed was used to form a reaction chamber. This chamber contained 0.5 ml of an aqueous electrolyte solution containing 20% sodium chloride, 10% calcium nitrate and 5% glycerine. The exothermic reaction was initiated by inserting the perforated capsule in the reaction chamber. Temperature was measured by inserting a thermocouple between the two chambers at about 15 mm from the bottom. For temperature measurements, the assembly was insulated with three wraps of paper towel. Following initiation, the temperature reached about 95° C. in less than 30 seconds and stayed at or above 100° C. for 7 minutes.

EXAMPLE 8

A pressed rod was made generally using the procedure described earlier. Sodium chloride was ground with a mortar and pestle to a fine powder. 4.8 g of −325 U.S. mesh magnesium powder from Morton Thiokol, Inc. was mixed with 3.2 g of −30 to +40 U.S. mesh magnesium/iron powder from Dymatron, Inc. in a small plastic beaker. 2 g of the powdered sodium chloride was then mixed with the metal powders. Pressure for pressing was supplied by a Forney compression tester. A 4,000 pound load was applied, generating 14,800 psi in the die, producing a pressed rod 0.09×0.136×3 inches, which was cut into 4 cm segments weighing about 0.5 g each. A test rod was wrapped in two layers of Kleenex tissue, each 2×2 inches and inserted into a 203" I.D. mylar tube. Thermocouples were attached to the tube, which was then wrapped with an insulating sleeve of Kleenex tissue. An electrolyte, 0.5 ml, containing 20% NaCl, 5% $Ca(NO_3)_2$, 5% glycerine and 70% water was injected into the bottom of the mylar tube. This test was repeated two more times. All samples reached a temperature of 90° C. within at least one minute and maintained a temperature at, or above, 90° C. for 11 minutes.

EXAMPLE 9

Figure 13:
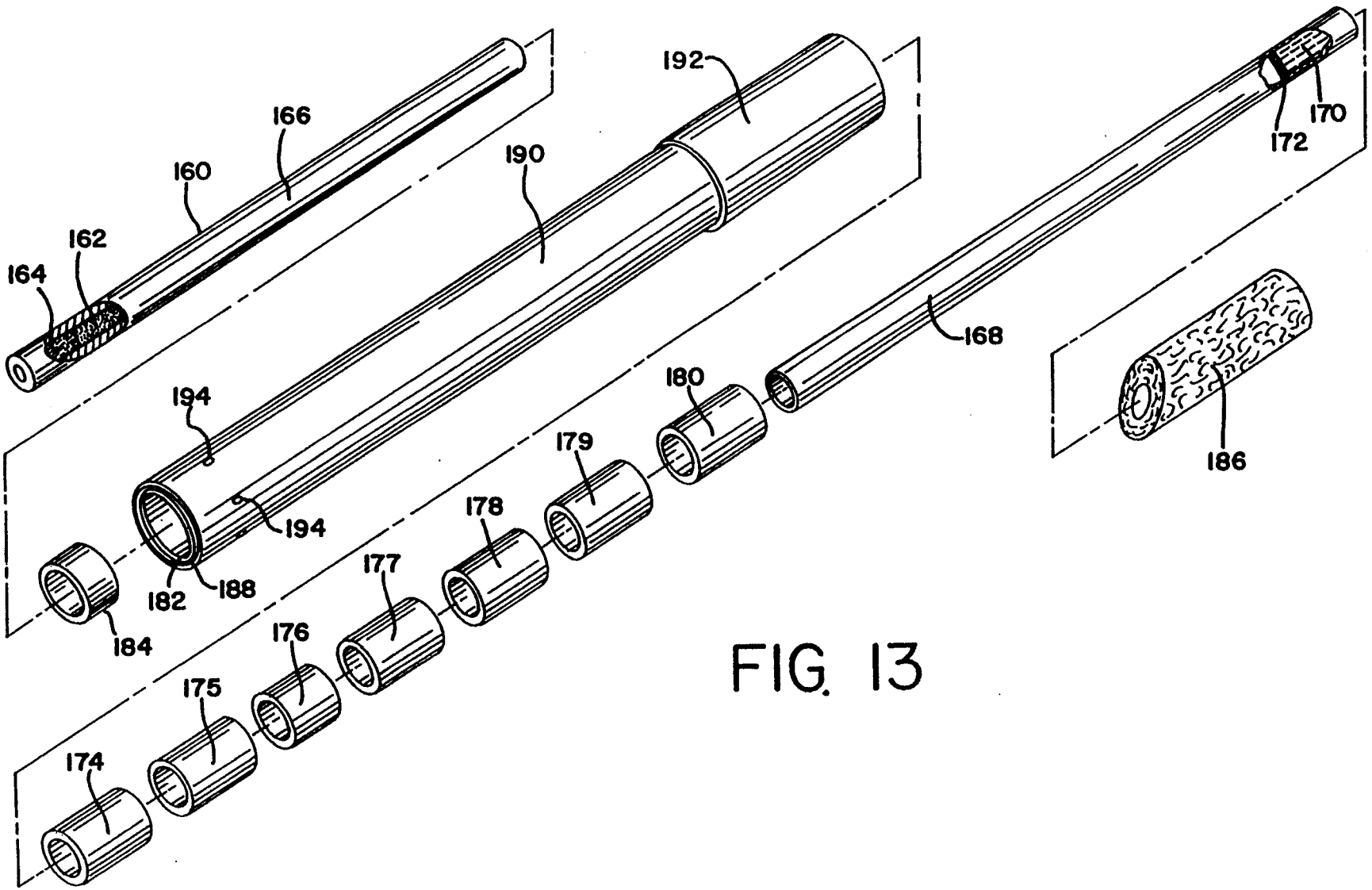
FIG. 13 is a prospective, exploded view of a cigarette using a preferred heat source of the present invention.

A cigarette using a heat-source of the preferred embodiment of the present invention is shown in FIGS. 13 and 14 and was constructed as follows. FIG. 13 is an exploded view, and FIG. 14 is a view showing the heat source partially inserted into the heat chamber.

The heat source 160 consists of a 6.0 cm length of extruded rod 162 having a diameter of 0.125 inches and a weight of about 0.37 g, made in accordance with Example 6, placed end to end with a cellulose fiber rod 164 (EF203032/82 available from Baumgartner, Lausanne-Crissier, Switzerland) 4.40 mm in diameter and 8.00 mm in length and held in place by wrapping the arrangement in an outerwrap 166 made of a two-ply segment of a Kleenex facial tissue 60×75 mm. The outer edge of the tissue is very lightly glued.

A mylar tube (J. L. Clark Manufacturing Co., Maryland) 0.208" in diameter and 3.4" in length with one end sealed with heat serves as the heat or reaction chamber 168 where the exothermic electro-chemical reaction takes place. This heat chamber 168 should be inspected after heat sealing to assure that the bottom portion did not shrink, which would interfere with its capacity and further assembly. This tube contains 0.45 ml of electrolyte solution 170, containing 20% sodium chloride, 10% calcium nitrate, 5% glycerine and 2% malic acid, sealed in the bottom behind a grease seal 172. The grease seal 172 is applied using a syringe loaded with grease. A first layer about 0.01 inches thick is applied just above the liquid level in the tube 168. A second layer of the same thickness is applied about 6mm above the liquid.

Reconstituted tobacco sheets (P2831-189-AA-6215, Kimberly-Clark Corporation, Ga.) consisting of 20.7% precipitated calcium carbonate, 20% wood pulp and 59.3% tobacco are cut into 60×70 mm segments and rolled into a 7 cm tube with an internal diameter of 0.208". Various flavoring materials and humectants are applied to the rod and equilibrated overnight. Preferred flavoring materials include the flavors produced as Samples 1–11 and 13–15 described earlier. Levulinic or other acids are applied to similar tobacco rods made with reconstituted sheets not containing calcium carbonate. The flavored tobacco tubes are cut into either 7 or 10 mm segments. Various segments from different tubes may then be used as segments 174–180 in the cigarette of the preferred embodiment. The segments 174–180 are placed on mylar tube 168 containing the electrolyte 170. It is important to note that the delivery of taste and flavor depends on, besides many other factors, the sequence in which the segments 174–180 are placed. In the preferred embodiment, the flavors applied to the segments 174–180 are as follows: 175—Latakia (Sample 9); 174—Burley (Sample from second heating stage of Extraction Run No. 3); 176—nicotine; 178—Latakia (Sample 9); 177—Burley (Sample from second heating stage of Extraction Run No. 3); 179—Turkish (Sample extracted from Cambridge filter pads after the first heating stage in Extraction Run No. 2); 180—combination of six flavors commonly used in tobacco.

The heat chamber 168 and the flavored tobacco segments 174–180 are inserted into another mylar tube 182, 100 mm long and 0.298" O.D. Collars 184 are fabricated from reconstituted tobacco sheet (P831-189-AA-5116, Kimberly-Clark corporation, Ga.) by rolling a segment of 20.5×6 cm to form a tube with a 0.293" O.D., 0.208" I.D. and 6.0 cm length. This tube is cut into 5 mm collars and held in place in the end of tube 182 with Elmer's glue.

The collar 184 at the end of the outer tube 182 serves to hold the heat chamber 168 in place. To the mouth end of the tube 182 is inserted a segment of COD filter 186, one end of which is cut at a 60 degree angle. The COD filter 186 is 13 mm long on the short side and has a passage hole 4.5 mm in diameter through the center.

The outer tube 182 is wrapped with a 0.006" thick polystyrene insulating material 188 (Astro Valcour Inc., N.Y.) 49×100 mm in dimension forming several layers, only one of which is shown. This is then overwrapped with cigarette paper 190 and tipping paper 192 (respectively P2831-77 and AR5704 from Kimberly-Clark Corporation, Ga.). The initiating end of the cigarette has a series of 5 air intake holes 194, equally spaced 72 degrees apart and 7 mm from the end, made with a 23 gauge B-D syringe needle. The collar 184 seals the front of the cigarette so that air that flows past the tobacco segments 174–180 may only enter through holes 194. The small amount of steam or other gases created by the reaction pass out the initiating end of the cigarette and are thus diverted away from the air intake holes 194.

The cigarette is activated by inserting the heat source 160 through collar 184 and into the heat chamber 168, forcing electrolyte 170 to flow along outerwrap 166 and into the extruded rod 162. When fully inserted, the end of heat source 160 will be flush with the end of the heat chamber 168 and collar 184. About 30 seconds after initiation, taste and flavor components are delivered to the mouth of the smoker upon puffing. If it is desired that the cigarette generate an aroma when activated, a drop of tobacco flavor extract may be added to the fiber rod 164 or end of heat source 160. Under normal puffing conditions the cigarette will deliver the flavor and taste components for at least 7 minutes. After this period the rate of delivery decreases.

Several advantages are obtained with preferred embodiments of the invention. The particle sizes of the atomized or milled frozen melts, or shreds of bimetallic foil, can be used to adjust surface areas and hence control the speed of the reaction. Likewise, pressing and extruding conditions may be varied to change the porosity of the heat source to optimize electrolyte penetration and thus the reaction rate. Alternatively, where the particles of metallic agents are packed into a straw, a water retention aid such as celite mixed with the powders keeps the water from vaporizing and escaping from the heat chamber.

The bimetallic foil geometry assures good electrical contact between the two metallic agents, even when the exposed surface of the anode corrodes. Also, this embodiment enables the ratio of the surface area to the total mass of the anode to be designed over a wide range of values simply by controlling the thickness of the anode. Limiting ranges of thickness are dictated by the ability to manufacture and process the bimetallic element.

The wire model (FIG. 6) presents the opportunity to control the rate of reaction by controlling the flow of electrons between the wire 94 and strands 92. For example, if the wire 94 and strands 92 are isolated electrically so that they only have one point of electrical contact, a resistor may be used as a means for controlling the rate of electrical current between the wire 94 and strands 92 to thereby control the rate of the electrochemical interaction.

Because the cigarette using a heat source of the present invention may be made to look like a conventional cigarette, it may inadvertently be attempted to be lit with a match, cigarette lighter or other flame. Therefore, the heat source preferably should not be combustible, or at least be self extinguishing if inadvertently contacted by a flame. One advantage of the pressed-rod heat sources is that they are compact enough that they have good heat transfer properties. As a result, if the end of the rod is contacted by a flame, the tightly compacted particles conduct the heat away, preventing the end from reaching a combustion temperature.

It should be appreciated that the structures and methods of the present invention are capable of being incorporated in the form of a variety of embodiments, only a few of which have been illustrated and described above. The invention may be embodied in other forms without departing from its spirit or essential characteristics. For example, even though the systems described herein use only two metallic agents, the heat sources may be made using more than two metallic agents that electrochemically interact. Thus, the described embodiments are to be considered in all respects only as illustrative and not restrictive, and the scope of the invention is, therefore, indicated by the appended claims rather than by the foregoing description. All changes which come within the meaning and range of equivalency of the claims are to be embraced within their scope.

We claim:

1. A method of forming an electrochemical heat source comprising the steps of:

a) providing particles comprising at least two metallic agents in electrical contact with one another;

b) extruding the particles into an extrusion; and c) dividing said extrusion to form an individual heat source.

2. The method of claim 1 wherein the at least two metallic agents are selected from the group consisting of iron, copper, nickel, palladium, silver, gold, platinum, carbon, cobalt, magnesium, aluminum, lithium, $Fe_2O_3$, $Fe_3O_4$, $Mg_2Ni$, $MgNi_2$, $Mg_2Ca$, $MgCa_2$, $MgCo_2$ and combinations thereof.

3. The method of claim 1 wherein deionized water is mixed with the particles prior to the step of extruding the particles.

4. The method of claim 1 wherein equipment used to extrude the particles is cooled prior to the extrusion process.

5. The method of claim 1 wherein a binder is mixed with the particles prior to extrusion.

6. The method of claim 3 wherein the particles are coated with a small amount of heptane prior to mixing the particles with water.

7. The method of claim 5 wherein the binder is first mixed with water to form a gel before being mixed with the particles.

8. The method of claim 5 wherein the binder comprises sodium carboxymethyl cellulose.

9. The method of claim 1 wherein the at least two metallic agents are in the form of a frozen melt of at least two metals.

10. The method of claim 1 wherein the at least two metallic agents comprise two metals in the form of a bimetallic foil.

11. The method of claim 1 wherein the at least two metallic agents are in the form of a mechanical alloy.

12. The method of claim 9 wherein the frozen melt comprises a combination of a first metal in crystalline form and an eutectic of the first metal and a second metal.

13. The method of claim 12 wherein the first metal comprises magnesium and the second metal comprises iron.

14. The method of claim 12 wherein the first metal comprises magnesium, the second metal comprises nickel, and the eutectic comprises magnesium and $Mg_2Ni$.

15. The method of claim 9 wherein the heat source comprises particles formed by atomizing the melt.

16. The method of claim 9 wherein the heat source comprises particles formed by machining an ingot of the frozen melt.

17. The method of claim 1 wherein the extrusion comprises a rod having a cross-sectional shape selected from the group consisting of a circle, square, annulus and star.

18. A method of forming an electrochemical heat source containing magnesium comprising the steps of:

a) providing particles comprising magnesium and at least one other metallic agent in electrical contact with the magnesium;

b) mixing a binder with deionized water to form a gel;

c) cooling the particles and gel;

d) mixing the cooled particles and cooled gel;

e) extruding the mixture of particles and gel into an extruded rod; and f) dividing said rod to form an individual heat source.

19. The method of claim 18 wherein the particles are mixed with heptane prior to being mixed with the gel.

20. The method of claim 18 wherein equipment used to extrude the particles and gel is cooled prior to use.

21. The method of claim 18 wherein the binder comprises about 6% of the extrudate.

22. The method of claim 19 wherein the ratio of particles to heptane is about 20:1.

23. The method of claim 18 wherein the extrudate is dried to remove the water.

24. An electrochemical heat source comprising:

a) a rod-shaped member comprising particles of at least two metallic agents in electrical contact with one another capable of interacting electrochemically with one another to produce heat; and b) an electrolyte absorbent material surrounding the rod-shaped member.

25. The electrochemical heat source of claim 24 wherein the particles are mixed with a binder.

26. The electrochemical heat source of claim 24 wherein the at least two metallic agents are in the form of a frozen melt of at least two metals.

27. The electrochemical heat source of claim 24 wherein the at least two metallic agents are in the form of a mechanical alloy.

28. The electrochemical heat source of claim 24 wherein the at least two metallic agents comprise magnesium and iron.

29. The electrochemical heat source of claim 24 wherein the at least two metallic agents comprise magnesium and nickel.

30. The electrochemical heat source of claim 26 wherein the frozen melt comprises magnesium and $Mg_2Ni$.

* * * * *